United States Patent [19]

Takemura et al.

[11] Patent Number: 4,975,740

[45] Date of Patent: Dec. 4, 1990

[54] PAGE ENTERING APPARATUS FOR ELECTROPHOTOGRAPHIC COPYING MACHINE

[75] Inventors: Yoshinobu Takemura, Kitakatsuragi; Yasuyuki Ishiguro, Osaka; Shingo Mori, Ikoma; Yasuhiro Matsuo, Osaka; Kuniaki Nakano, Kitakatsuragi; Hisahiro Kato, Neyagawa, all of Japan

[73] Assignee: Mita Industrial Co., Ltd., Osaka, Japan

[21] Appl. No.: 420,813

[22] Filed: Oct. 12, 1989

[30] Foreign Application Priority Data

Oct. 14, 1988 [JP] Japan ..... 63-259961

[51] Int. Cl.[5] ..... G03G 15/00

[52] U.S. Cl. ..... 355/202; 355/308; 355/40

[58] Field of Search ..... 355/202, 244, 308, 319, 355/40, 75, 218

[56] References Cited

U.S. PATENT DOCUMENTS 4,845,525 7/1989 Ito ..... 355/319 X 4,916,489 4/1990 Takeda et al. ..... 355/218 X

*Primary Examiner*—Joan H. Pendegrass

*Attorney, Agent, or Firm*—Beveridge, DeGrandi & Weilacher

[57] ABSTRACT

When documents fed by an automatic document feeder are subjected to the first copying operation, the documents are counted one by one. Alternately, the total number of documents are calculated by dividing the number of copy paper sheets sent to an intermediate tray, by the preset number of copies. Page entry is made in the copy paper sheets taken out from the intermediate tray, based on the total number of documents thus obtained. The total number of documents may be automatically counted. Accordingly, even though the documents are successively fed, starting from the last-page document, page entry may be made. The operator is not required to manually count the total number of documents.

16 Claims, 10 Drawing Sheets

PAGE ENTERING APPARATUS FOR ELECTROPHOTOGRAPHIC COPYING MACHINE

BACKGROUND OF THE INVENTION

The present invention relates to a page entering apparatus for an electrophotographic copying machine.

There is known an electrophotographic copying machine capable of entering page data in copying paper, as disclosed by, for example, Japanese laid open patent publication No. 106224/1979, No. 202479/1984 or No. 148939/1987. In such an electrophotographic copying machine, a page number is generally displayed on a liquid crystal display, an electro-chromic display or the like disposed at the tip or the like of the document placing surface, and the page number thus displayed is copied together with the original document.

According to the conventional page entry, a page number is merely entered in a numerical order "1", "2", "3" . . . each time the document is renewed.

There is known an electrophotographic copying machine on which mounted is an automatic document feeder (ADF) (including the type of circulating documents and the type of not circulating the documents; The former type will be hereinafter referred to as a recirculating document handler (RDH)). In such a copying machine, there are instances where page numbers are to be entered in copy paper sheets while the documents are automatically fed by the ADF. In such a case, in a copying machine of the type in which a plurality of documents set on the ADF are fed one by one, to the document placing surface, starting from the last-page document, the page numbers cannot be entered in copy paper sheets unless the total number of the set documents is previously set. Accordingly, the operator should manually count the total number of documents and enter such data through keys before starting the copying oepration. It takes a great deal of trouble in view of maneuverability.

Even in a copying machine of the type in which a plurality of documents set on the ADF are fed one by one, starting from the first-page document, the page numbers cannot normally be entered in such manner as to represent the relationship with respect to the total number of the documents, i.e., page numbers in the form of "1/n", "2/n", "3/n" and so forth cannot be entered in copying paper sheets, where n is the total number of documents.

SUMMARY OF THE INVENTION

It is an object of the present invention to provide a page entering apparatus for an electrophotographic copying machine, capable of automatically counting the total number of documents to be copied and entering the page numbers based on the total number of documents thus counted.

The present invention provides a page entering apparatus applied to an electrophotographic copying machine having (i) an automatic document feeder for automatically feeding documents to be copied, one by one, and (ii) an intermediate housing portion for temporarily housing copy paper on which the documents have been copied.

The page entering apparatus in accordance with the present invention comprises, as set forth in claim 1:

counting means for counting, at the time of copying operation, the total number of documents fed from the automatic document feeder;

page number storing means for storing a page number based on a count value of the counting means; and page number entry processing means for executing a page number entry processing based on an output from the page number storing means, after the copy paper has been housed in the intermediate housing portion.

According to the invention of claim 1, the total number of documents n may be automatically counted with the use of the automatic document feeder at the time of copying operation. Thereafter, the copy paper is sent to the intermediate housing portion, and the page number based on the total number of the documents may be entered.

The present invention provides a page entering apparatus comprising, as set forth in claim 2; storing means for storing the number of copies previously set; counting means for counting the number of copy paper sheets housed in the intermediate housing portion; operating means for calculating the number of documents based on the preset number of copies stored in the storing means and a count value of the counting means; and page number entry processing means for executing a page number entry processing based on the page number calculated by the operating means, after the copy paper housed in the intermediate housing portion has been taken out.

According to the invention of claim 2, at the time when the copy paper sheets are guided to the intermediate housing portion, the number of copy paper sheets E is counted, and the total number of the documents n may be calculated by dividing the number of copy paper sheets E by the preset number of copies A. At the subsequent step, the page entry processing based on the total number of the documents may be executed.

The present invention further provides a page entering apparatus comprising, as set forth in claim 9: counting means for counting the total number of set documents with the use of the automatic document feeder mentioned earlier, before a copying operation is executed; page number storing means for storing a page number based on a count value of the counting means; and page number entering means for entering, in association with the copying operation, a page number supplied from the page number storing means, in copy paper.

According to the invention of claim 9, the counting means automatically counts the total number of set documents n with the use of the automatic document feeder before a copying operation is executed. In a particular case where there is used an automatic document feeder of the recirculating type, the documents are set again as originally done, at the time when the counting operation is complete. Accordingly, after the counting operation has been finished, the sequence may proceed to a document feeding step necessary for copying the documents, without additional operations required. At the time of document copying operation, the page number obtained based on the total number of documents is entered in the copy paper by the page number entering means.

Being arranged as above-mentioned, the present invention may provide a page entering apparatus for an electrophotographic copying machine, capable of automatically counting or calculating the total number of documents to be copied, and entering a page number based on the total number of documents.

The features of the present invention will be apparent from the following description with reference to the attached drawings.

DESCRIPTION OF THE PREFERRED EMBODIMENTS

[First Embodiment]

Figure 1:
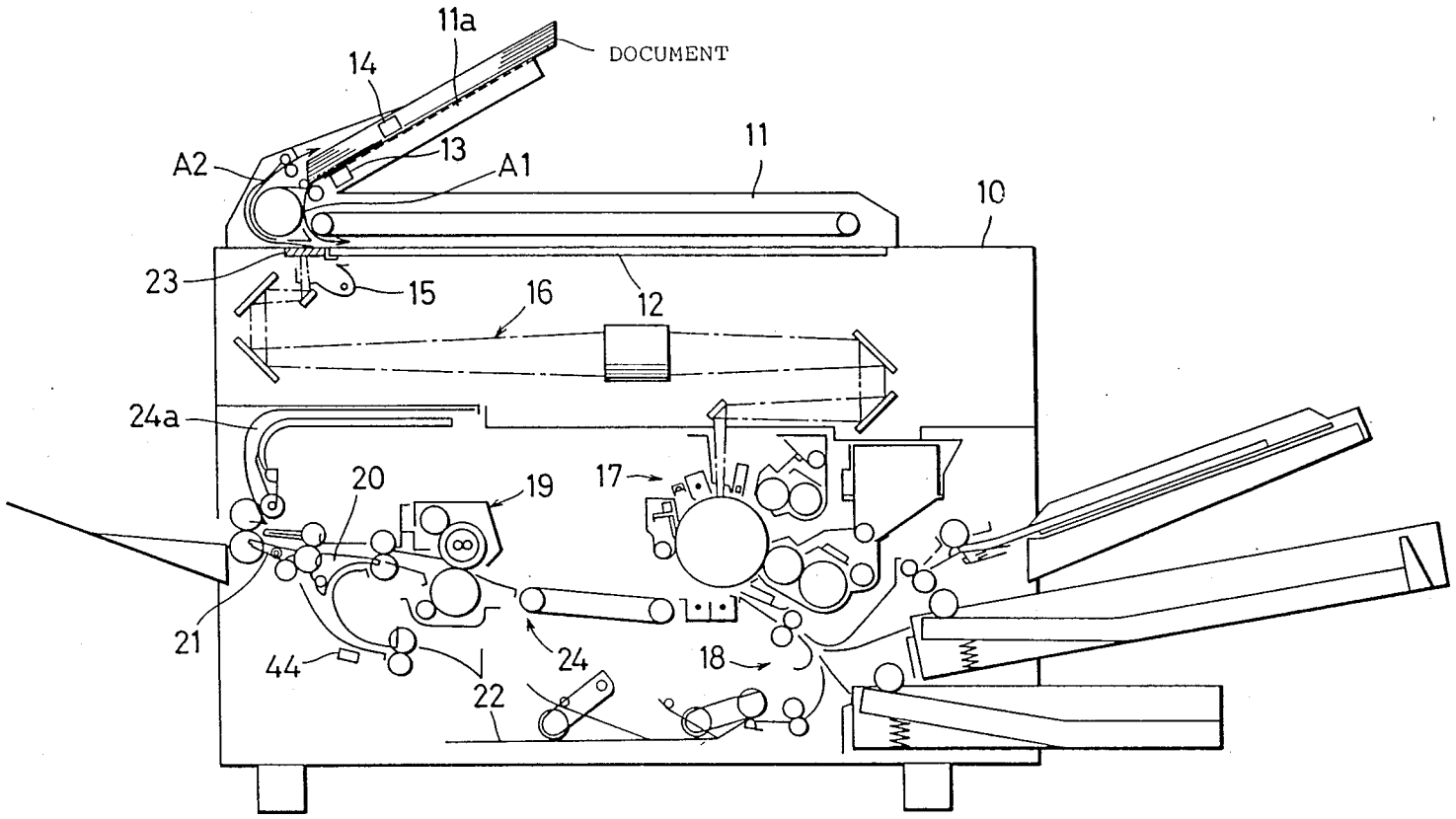
FIG. 1 is a schematic section view illustrating the arrangement of an electrophotographic copying machine having a RDH and an intermediate tray, to which applied is a page entering apparatus in accordance with an embodiment of the present invention.

FIG. 1 is a schematic section view illustrating the arrangement of an electrophotographic copying machine incorporating a page entering apparatus in accordance with an embodiment of the present invention.

The electrophotographic copying machine has a main body 10 on the top of which a recirculating document handler 11 (hereinafter referred to as RDH) is mounted. As shown in FIG. 1, a plurality of documents to be copied are set on a document setting portion **11*a* of the RDH 11 with the character surfaces of the documents turned up. In a pile of the documents, the first-page document is placed on the top while the last-page document is placed at the bottom. At the time of copying operation, the documents are successively taken out, starting from the last-page document at the bottom. The document thus taken out is then sent in a direction shown by an arrow A1 and set on a transparent platen 12. The document for which a copying operation has been finished, is collected in a direction shown by an arrow A2 from the transparent platen 12, and returned to the top of the documents on the document setting portion 11*a*. Thus, the documents set on the RDH 11** are circulated.

A document set detecting sensor 13 and a last-document detecting sensor 14 are disposed at the document setting portion **11*a* of the RDH 11. The document set detecting sensor 13 is disposed for checking whether or not the documents are set on the RDH 11. In order to prevent the documents once circulatingly fed and returned from being again fed to the transparent platen 12, the last-document detecting sensor 14** is disposed for distinguishing between the last document, i.e., the highest document out of a plurality of initially set documents, and the documents which have been once fed and returned onto this last document in a circulating manner.

Disposed in the body 10 are: an illumination device 15 for illuminating the document set on the transparent platen 12; an optical system 16 for guiding the light reflected from the document; an image forming mechanism 17 for forming an electrostatic latent image of the document by an electrophotographic method and for developing the electrostatic latent image thus formed, into a toner image; a copy paper feeding mechanism 18 and a copy paper delivery mechanism 24 for feeding and deliverying copy paper; and a fixing device 19 for fixing the toner image transferred onto copy paper.

The copy paper delivery mechanism 24 includes switching guides 20, 21 and an intermediate tray 22. The switching guides 20, 21 are so arranged as to switch the direction of the copy paper delivery passage to guide, to the intermediate tray 22, the copy paper for which one copying operation has been made.

Disposed at the inlet of the intermediate tray 22 is a sensor 44 for detecting a paper jam.

The switching guide 20 is adapted to be driven when executing a copying operation on the surface of copy paper on which a page number or the like has been already copied. When the switching guide 20 is operated, the copy paper sent from the fixing device 19 is guided to the intermediate tray 22 with the paper forward end being at the head.

The switching guide 21 is adapted to be driven when executing a copying operation on the reverse surface of copy paper. When the switching guide 21 is operated, the copy paper sent from the fixing device 19 is once entered into a switch-back delivery passage **24*a*, and then guided to the intermediate tray 22** with the paper rearward end being at the head.

In this embodiment, a page number display 23 is disposed along the tip edge of the transparent platen 12. This page number display 23 is so arranged as to be illuminated by the illumination device 15. Accordingly, when the document on the upper surface of the transparent platen 12 is illuminated and scanned, the page number display 23 may also be illuminated and scanned and the light reflected therefrom may be guided to the image forming mechanism 17 by the optical system 16. Thus, the page number image may be formed at the upper portion of the document image.

The page number display 23 may be a liquid crystal display or an electro-chromic display, or may include a movable film. Further, the page number display 23 may include erase means and pixel display means as disclosed by Japanese Patent Application No. 98950/1988 filed by the Applicant.

The position of the page number display 23 is not limited to the tip edge of the transparent platen 12, but this may also be disposed at the rear end or lateral end thereof which may be illuminated by the illumination device 15.

Figure 2:
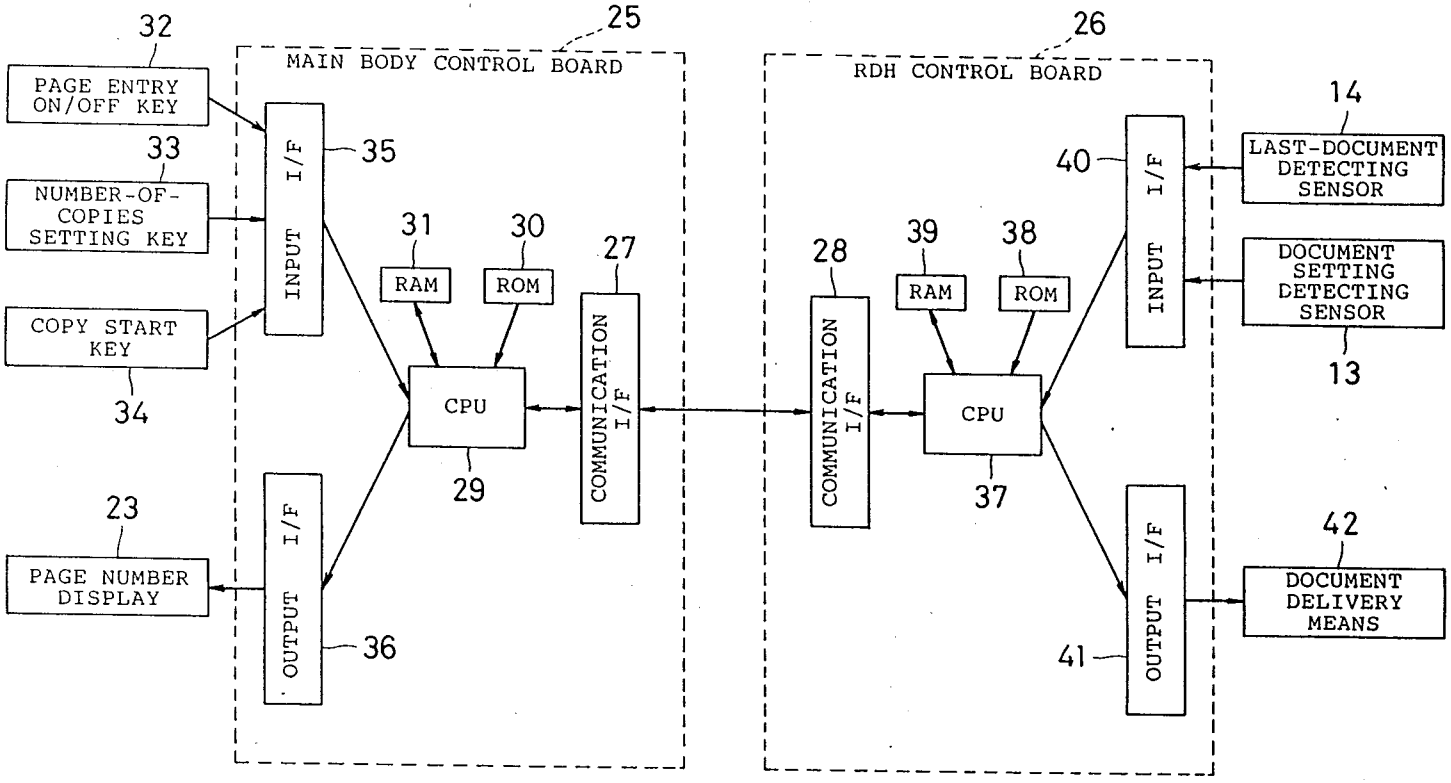
FIG. 2 is a block diagram illustrating the arrangement of an electric control circuit in the electrophotographic copying machine in FIG. 1.

FIG. 2 is a block diagram illustrating the arrangement of an electric control circuit in the electrophotographic copying machine in FIG. 1.

The main body 10 has a main body control board 25 and the RDH 11 has a RDH main control board 26. These boards 25, 26 are connected to each through communication interfaces 27, 28 respectively mounted on these boards 25, 26.

Mounted on the main body control board 25 are a CPU 29 as a control center, a ROM 30 containing an operation program of the CPU 29, a read/write random-access memory RAM 31, an input interface 35, an output interface 36 and the communication interface 27 above-mentioned.

Provision is made such that input signals from a page entry ON/OFF key 32, a number-of-copies setting key 33 and a copy start key 34 are supplied to the CPU 29 through an input interface 35. These page entry ON/-OFF key 32, the number-of-copies setting key 33 and the copy start key 34 are disposed on an operation panel (not shown) of the main body 10, for example, on the top thereof toward the operator. These keys may be pushed by the operator. Provision is also made such that a page number signal and other control signals are supplied from the CPU 29 to the page number display 23 through the output interface 36.

Likewise the main body control board 25, the RDH control board 26 has a CPU 37, a ROM 38, a RAM 39, an input interface 40, an output interface 41 and a communication interface 28. Provision is made such that signals from the document set detecting sensor 13 and the last-document detecting sensor 14 are supplied to the CPU 37 through the input interface 40. Provision is also made such that a control signal is supplied from the CPU 37 to document delivery means 42 through the output interface 41.

In this embodiment, the control circuit is arranged such that the main control board 25 and the main control board 26 are respectively disposed at the main body 10 and the RDH 11 and connected to each other. However, the control circuit may be formed with one main control board centered.

Figure 3A:
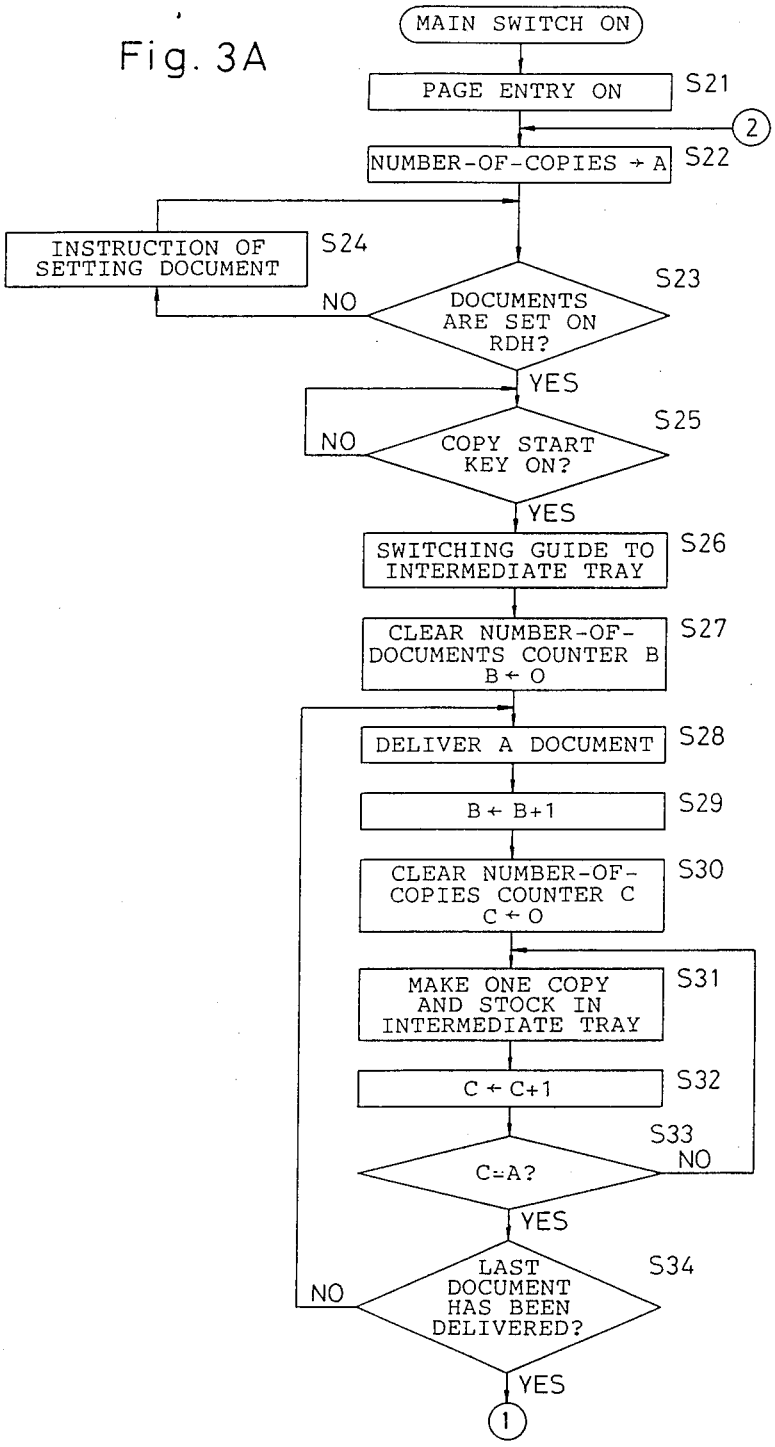
FIGS. 3A and 3B is a flow chart illustrating an example of page entry control operations in the electrophotographic copying machine in FIG. 1.
Figure 3B:
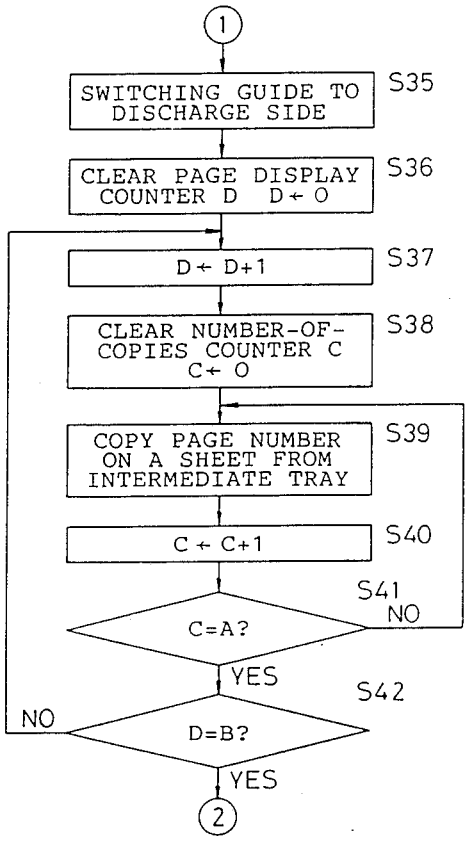

FIG. 3 is a flow chart of page entry procedure illustrating the control operations of the control circuit in FIG. 2. The following description will discuss the control operations along the flow in FIG. 3.

When the page entry ON/OFF key 32 is turned ON with the main switch of the main body 10 turned ON, the control circuit is set to a page entry ON mode (step S21). In this mode, when the number of copies is entered by the number-of-copies setting key 33, the CPU 29 sets such number data in a number-of-copies memory area A of the RAM 31 (step S22). Then, it is judged based on an input signal from the document set detecting sensor 13 whether or not documents are set on the RDH 11 (step S23). If no documents are being set on the RDH 11, an instruction of setting the documents is given (step S24). Such instruction may be displayed on, for example, a display unit (not shown) disposed at the main body 10 or a display unit disposed at the RDH 11. Such instruction may also be supplied with sound.

When the CPU 29 judges that the copy start key 34 has been turned ON (step S25), the CPU 29 sends a signal to the CPU 37 and the CPU 37 executes operations of steps S26 to S34. That is, when the CPU 29 judges that the copy start key 34 has been turned ON, the switching guide 20 is switched so that the copy paper is delivered to the intermediate tray 22 (step S26).

Then, the CPU 37 clears a number-of-documents counter B disposed at the RAM 39 (step S27).

A control signal is then supplied to the document delivery means 42. The lowest document out of the documents initially set on the RDH 11 is first delivered and set on the transparent platen 12 (step S28). The number-of-documents counter B is incremented by +1 (step S29).

The CPU 29 of the main control board 25 clears a number-of-copies counter C disposed at the RAM 31 (step S30) and executes a copy operation control for making one copy of the document set on the transparent platen 12. At this time, the switching guide 20 is being switched toward the intermediate tray 22, as discussed in connection with the step S26. Accordingly, the copy paper is stocked in the intermediate tray 22 (step S31). Then, the CPU 29 causes the number-of-copies counter C of the RAM 31 to be incremented by +1 (step S32). The CPU 29 judges at a step S33 whether or not a count value of the number-of-copies counter C reaches the number of copies previously set in the memory area A at the step S22 (The number of copies will be hereinafter referred to as A). If the count value of the number-of-copies counter C has not reached the preset number of copies, the operations of the steps S31, S32 are repeated so that the document is copied as often as the preset number of copies. Thus, A-piece copy paper sheets on which the first copying operation has been made, are stocked in the intermediate tray 22.

Afterwards, the CPU 29 sends a signal to the CPU 37. The CPU 37 drives the document delivery means 42 so that the document set on the transparent platen 12 is collected. When the last document out of the documents set on the RDH 11 has not been delivered yet (step S34), the operations of steps S28 to S33 are repeated. As the result, each of a plurality of documents set on the RDH 11, for example, n documents, is copied by A-times, and the copy paper sheets are stocked in the intermediate tray 22.

When the CPU 37 judges that the last nth document has been delivered (step S34), such judgement is informed to the CPU 29. The CPU 29 then switches the switching guide 20 to the discharge side (step S35). This causes the copy paper sheets for which a copying operation is subsequently made, to be discharged to a discharge tray.

The CPU 29 clears a page display counter D of the RAM 31 (step S36) and increments the same by +1 (step S37). The count value of the page display counter D is read by the CPU 29 and displayed on the page number display 23. Further, the CPU 29 clears the number-of-copies counter C (step S38) and takes out one copy paper sheet from the intermediate tray 22. Then, only the page number displayed on the page number display 23 is copied on the copy paper sheet thus taken out (step S39). At this time, the copy paper sheets in the intermediate tray 22 are successively taken out, starting from the top sheet. Of the copy paper sheets stocked in the intermediate tray 22, the top copy paper sheet contains a copied image of the top document of the documents initially set on the RDH 11. The lower copy paper sheets have greater page numbers. Accordingly, when the copy paper sheets are taken out from the intermediate tray 22, page numbers may be successively entered, starting from the lowest number. It is a matter of course that the RDH 11 is not under operation at this time.

Upon completion of a copying operation for one copy paper sheet taken out from the intermediate tray 22, the number-of-copies counter C is incremented by +1 (step S40). It is then judged whether or not the count value of the number-of-copies counter C is identical with the number of copies A set at the step S22 (step S41). If not identical, the copy paper sheets are taken out from the intermediate tray 22 and a copy operation is made on the sheets thus taken out until the count value reaches the preset number of copies A.

At a step S42, the count value of the page display counter D is compared with the count value of the number-of-documents counter B (step S37). If both values are not identical, the page display counter D is incremented by +1 and the next page number, for example "2", is displayed on the page number display 23. Then, the number-of-copies counter C is cleanred (step S38), and the copy paper sheets are taken out from the intermediate tray 22. The page number "2" is then copied on A-piece copy paper sheets thus taken out (steps S39, 40, 41).

When the count value of the page display counter D and the count value of the number-of-documents counter B are identical with each other (step S42), this means that all the copy paper sheets in the intermediate tray have been copied and a series of operations are complete.

In this embodiment, there is carried out a composite copy in which two copying operations are made on each copy paper sheet. More specifically, at the first copying operation, the documents are copied and the copy paper sheets are stocked in the intermediate tray 22. Each time one document is copied, "1" is added as the number of documents. At the second copying operation, page numbers based on the number of documents thus obtained are copied on the copy paper sheets discharged from the intermediate tray 22. Thus, the number of documents may be automatically counted without the necessity of manual counting and the page numbers may be respectively entered.

In this embodiment, two copying operations are made on each copy paper sheet. However, there may be carried out a composite copy in which three or more copying operations are made on each copy paper sheet. In such a case, provision may be made such that the number of documents is counted at the time of the first or second copying operation, and only the page numbers are entered at the time of the last copying operation.

In this embodiment, when the page entry is made at the step S39, the number of documents B is already known. Accordingly, the page numbers may be entered in such manner as to represent the relationship with respect to the total number of documents, i.e., the page numbers in the form of "1/n", "2/n", "3/n" and so forth can be entered in the copy paper sheets, where n is the total number of documents.

In this embodiment, the ADF may be of the type in which the documents are successively fed, starting from the first-page one. In this case, the top copy paper sheet of the copy paper sheets stocked in the intermediate tray, corresponds to the last-page document. Accordingly, the page numbers are successively entered, starting from the largest one. At this time, the page numbers may also be entered in the form of "n/n", "n−1/n", "n−2/n" and so forth.

[Second Embodiment]

In the control operations in FIG. 3, the number of documents is counted when the documents are sent to the transparent platen 12 by the RDH 11 (steps S28, S29). However, the number of documents may be counted in a different manner as outlined below.

Figure 4A:
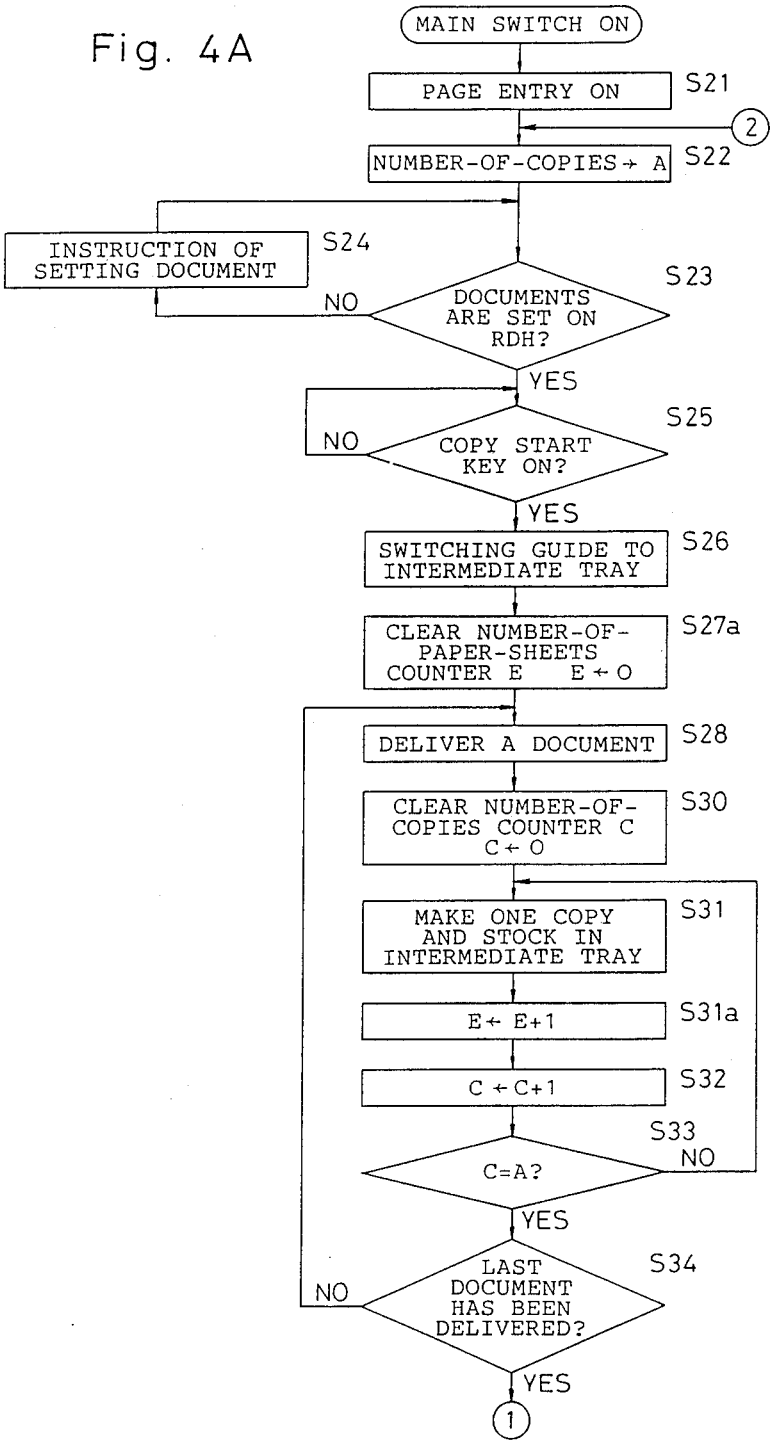
FIGS. 4A and 4B is a flow chart illustrating another example of the page entry control operations in the electrophotographic copying machine in FIG. 1.
Figure 4B:
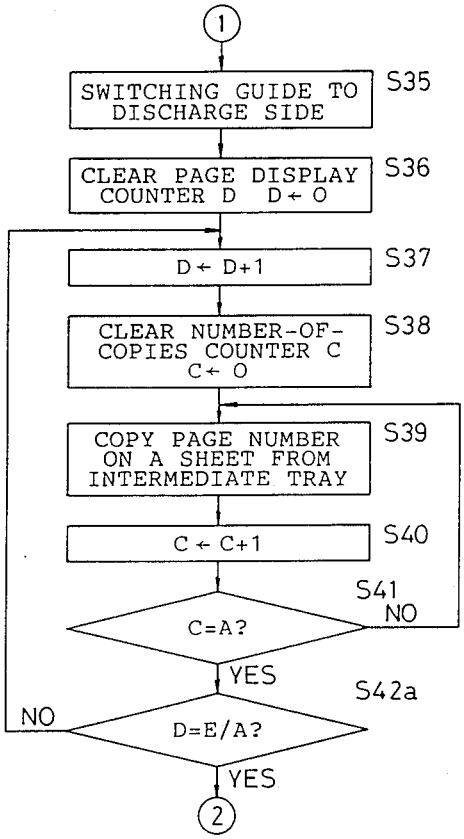

FIG. 4 is a flow chart illustrating another example of the operations of the control circuit in FIG. 2. The following description will discuss the page entry procedure along the flow in FIG. 4.

In FIG. 4, the operations from the step S21 to the step S26 are the same as described in connection with FIG. 3. Accordingly, the description thereof is here omitted.

When the switching guide 20 is switched to deliver the copy paper to the intermediate tray 22 at the step S26, the number of copy paper sheets on which the first copying operation has been made and which are stocked in the intermediate tray 22, is counted by, for example, a jam sensor 44 upstream of the intermediate tray 22.

Then, the CPU 29 sends a control signal to the CPU 37. The CPU 37 clears a number-of-paper-sheets counter E disposed at the RAM 39 (step **S27*a*). The CPU 37 gives a control signal to the document delivery means 42 so that the lowest document of the documents initially set on the RDH 11 is first delivered and set on the transparent platen 12 (step S28**).

On the other hand, the CPU 29 on the main control board 25 clears the number-of-copies counter C disposed at the RAM 31 (step S30) and controls such that a document set on the transparent platen 12 is copied on a copy paper sheet. At this time, the switching guide 20 is being switched toward the intermediate tray 22 as described in connection with the step S26. Accordingly, the copy paper sheet is stocked in the intermediate tray 22 (step S31). Afterwards, the CPU 37 controls so that the number-of-paper-sheets counter E is incremented by +1 (step **S31*a*). The CPU 29 controls so that the number-of-copies counter C of the RAM 31 is incremented by +1 (step S32). The CPU 29 judges whether or not the count value of the number-of-copies counter C reaches the number of copies A previously set in the memory area A at the step S22 (step S33). If the count value of the number-of-copies counter C has not reached the preset number of copies A, the operations of the steps S31, S31*a* and S32 are repeated as often as the preset number of copies A. Thus, A-piece copy paper sheets on which the first copying operation has been made, are stocked in the intermediate tray 22**.

Thereafter, the CPU 29 sends a signal to the CPU 37. The CPU 37 drives the document delivery means 42 so that the document set on the transparent platen 12 is collected. Until the last document of the documents set on the RDH 11 is delivered (step S34), the control operations from the step S28 are repeated. Thus, each of a plurality of documents set on the RDH 11, for example n documents, is copied by A-times, and the copy paper sheets are stocked in the intermediate tray 22.

When the CPU 37 judges that the last nth document has been delivered (step S34), the CPU 37 informs such delivery to the CPU 29. The CPU 29 switches the switching guide 20 toward the paper discharge side (step S35). Thus, the copy paper sheets on which a copying operation is subsequently made, will be discharged to the discharge tray.

Then, the CPU 29 clears the page display counter D of the RAM 31 (step S36) and then increments by +1 this counter D (step S37). Likewise in the embodiment mentioned earlier, the count value of the page display counter D is read by the CPU 29 and displayed on the page number display 23. The CPU 29 clears the number-of-copies counter C (step S38), and then takes out one copy paper sheet from the intermediate tray 22. Only the page number displayed on the page number display 23 is then copied on this copy paper sheet (step S39). At this time, the copy paper sheets are successively taken out from the intermediate tray 22, starting from the top one. Of the copy paper sheets stocked in the intermediate tray 22, the top copy paper sheet contains a copied image of the top or first-page document of the documents initially set on the RDH 11. The lower copy paper sheets have greater page numbers. Accordingly, when the copy paper sheets are taken out from the intermediate tray 22, page numbers may be sucessively entered, starting from the lowest number.

Upon completion of a copying operation for one copy paper taken out from the intermediate tray 22, the number-of-copies counter C is incremented by +1 (step S40). It is then judged whether or not the count value of the number-of-copies counter C is indentical with the number of copies A previously set at the step S22 (step S41). Until the count value of the number-of-copies counter C reaches the preset number of copies A, A-piece copy paper sheets are taken out from the intermediate tray 22 and page entry is carried out on such sheets.

At a step S42*a*, the count value of the page display counter D is compared with the quotient E/A in which the count value of the number-of-paper-sheets counter E is divided by the number of copies A previously set in the memory area A. If the count value is not identical with the quotient, the sequence is returned to the step S37. The page display counter D is incremented by +1 so that the next page number, for example "2", is displayed on the page number display 23. The number-of-copies counter C is then cleared (step S38). The page number "2" is copied on A-piece copy paper sheets taken out from the intermediate tray 22 (steps S39, S40, S41).

When the count value of the page display counter D is indentical with the quotient E/A (step S42*a*), this means that all the paper sheets in the intermediate tray 22 have been copied and a series of operations are complete.

According to this embodiment, the number of copy paper sheets on which the first copying operation has been made and which are stocked in the intermediate tray 22, is counted with the use of, for example, the jam sensor 44 upstream of the intermediate tray 22. The number of copy paper sheets stocked in the intermediate tray 22 is equal to "A×n" in which the number of copies A is multiplied by the number of documents n. Accordingly, the number of documents n may be calculated by dividing the number of copy paper sheets counted by the jam sensor 44, by the preset number of copies A. In the second copying operation, based on the number of documents thus obtained, the page number is copied on the copy paper sheets discharged from the intermediate tray 22.

In this embodiment, two copying operations are made on each copy paper sheet. However, there may be carried out a composite copy in which three or more copying operations are made on each copy paper sheet. In such a case, provision may be made such that the number of copy paper sheets is counted at the first or second copying operation, and only the page number is entered at the time of the last copying operation.

According to this embodiment, when page entry is made at the step S39, the number of paper sheets E and the number of copies A are already known. Therefore, the number of documents E/A is also known. Accordingly, the page numbers may be entered in such manner as to represent the relationship with respect to the total number of the documents, i.e., the page numbers in the form of "1/n", "2/n", "3/n" and so forth can be entered in the copy paper sheets, where n is the total number of documents.

In this embodiment, the ADF may be of the type in which the documents are successively fed, starting from the first-page one. In this case, the top paper sheet of the copy paper sheets stocked in the intermediate tray, corresponds to the last page. Accordingly, page numbers are successively entered, starting from the largest one. At this time, page numbers may also be entered in the form of "n/n", "n−1/n", "n−2/n" and so forth.

[Third Embodiment]

According to the first and second embodiments above-mentioned, the documents are first copied on copy paper fed from the paper cassette, and the copy paper is then guided to the intermediate tray.

However, provision may be made such that, when the document is circulated with the use of the RDH 11, the copying operation is not be carried out and the copy paper is temporarily housed in the intermediate tray, then the pages of documents are calculated by the RDH 11, or the pages of documents are calculated based on the number of copy paper sheets and the set number of copies, and when copying the document on the copy paper thus housed in the intermediate tray, page entry is made based on the calculated copy data.

According to such arrangement, provision may be made such that the document is not copied on copy paper but the copy paper is merely stocked in the intermediate tray at the step S31 in each of the flow charts in FIG. 3 and FIG. 4 and the document is copied together with page entry at the step S39. Other operations than the steps S31 and S39 are the same as each of the flow charts in FIGS. 3 and 4.

[Fourth Embodiment]

In the first to third embodiments above-mentioned, the documents are copied only on one side of copy paper. However, the present invention may be applied to the application in which documents are copied on both sides of copy paper.

The following description will discuss how to carry out a both-side copying operation, for example, in the second embodiment in which the number of copy paper sheets stocked in the intermediate tray 22 is counted at the time of the first copying operation, and based on the number of documents thus obtained, a page number is copied on the copy paper sheets discharged from the intermediate tray 22 at the time of the second copying operation.

The copy paper on the obverse surface of which a document has been copied and which has been sent from the fixing device 19, is guided to the intermediate tray 22 through the switching guide 20.

At this time, the number of copy paper sheets E on the obverse surfaces of which the documents have been copied and which are housed in the intermediate tray 22, is counted in the same manner as shown in FIG. 4.

Based on the quotient E/A in which the count value E is divided by the preset number of copies A, the copy data D are calculated. Based on the copy data D, obverse-side page entry is made in the copy paper sheets taken out from the intermediate tray 22. Then, the switching guide 21 is operated so that the copy paper sheets sent from the fixing device 19 are once entered into the switch-back delivery passage 24a and then guided into the intermediate tray 22 with the rear ends of the copy paper sheets being at the head. With the obverse and reverse surfaces of the copy paper sheets inverted, the copy paper sheets are again housed in the intermediate tray. Afterwards, the documents are copied on the reverse surfaces of the copy paper sheets in the intermediate tray, and reverse-side page entry is made by repeating the same operations as mentioned above.

[Fifth Embodiment]

In the first to fourth embodiments, the description has been made of the electrophotographic copying machine having the RDH 11 mounted on the main body 10. However, the present invention may be applied to not only the electrophotographic copying machine having the RDH 11 mounted on the main body 10, but also, as shown in FIG. 5, an electrophotographic copying machine having an automatic document feeder 51 (hereinafter referred to as ADF) of the non-recirculation type, instead of the RDH 11, on the main body 10.

The following description will discuss the function of the ADF of the non-recirculation type.

Figure 5:
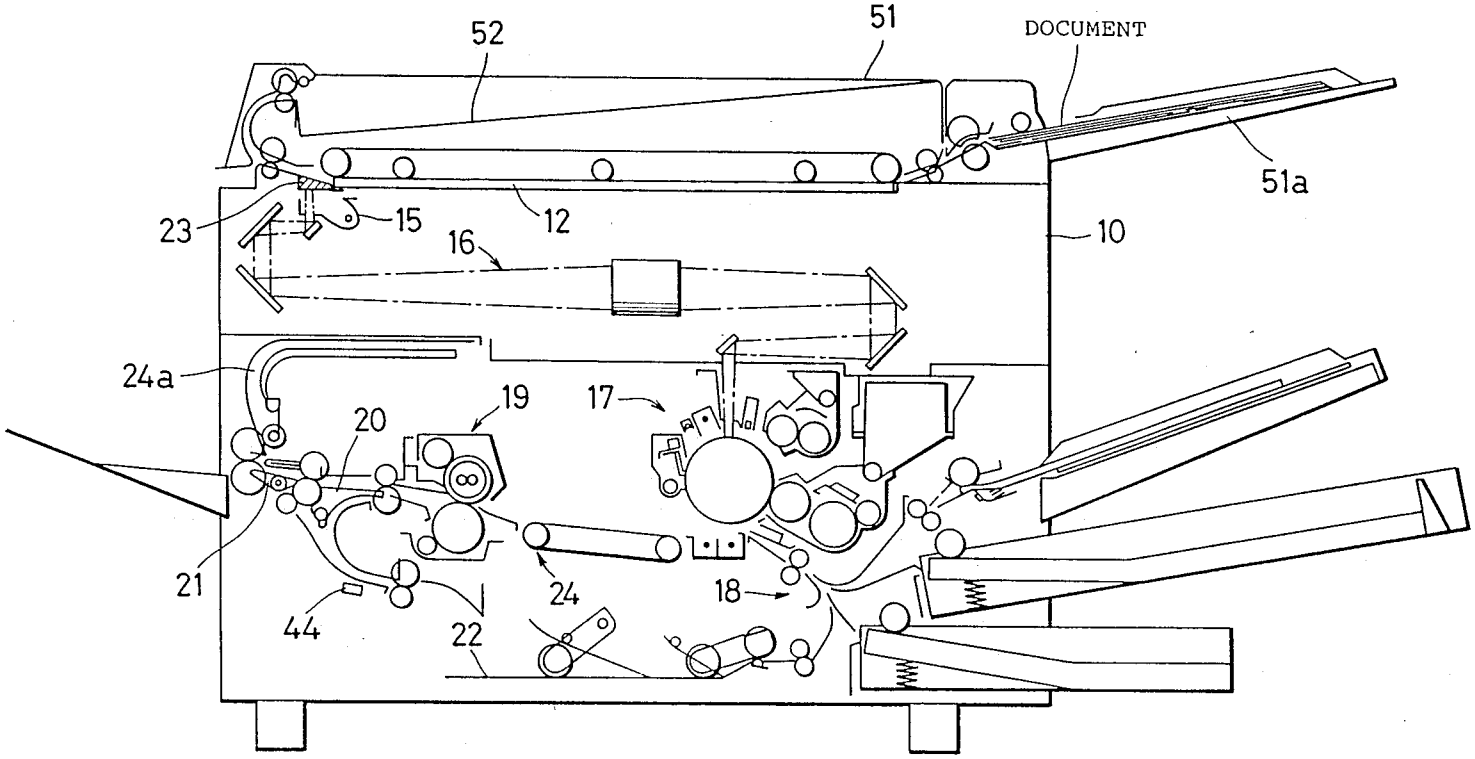
FIG. 5 is a schematic section view illustrating the arrangement of an electrophotographic copying machine having an ADF of the non-circulation type and an intermediate tray, to which applied is the page entering apparatus in accordance with a further embodiment of the present invention.

A plurality of documents to be copied are set on a document setting portion 51a of the ADF 51 with the document surfaces turned down and the lowest document corresponding to the first page, as shown in FIG. 5. At the time of copying operation, the documents are successively taken out, starting from the top, i.e., last-page document, and set on the transparent platen 12. The document of which copying has been finished, is collected from the transparent platen 12 to a document receiving portion 52 disposed at the top of the ADF 51. Likewise in the electrophotographic copying machine having the RDH 11 mentioned earlier, page entry is made starting from the highest number.

The control operations for entering page numbers in copy paper housed in the intermediate tray, are similar to those in the embodiments mentioned earlier. Accordingly, the description of such control operations is here omitted.

In this fifth embodiment, the ADF may be of the type in which the documents are successively fed, starting from the first-page document. In this case, the top paper sheet of the copy paper sheets stocked in the intermediate tray corresponds to the last-page document. Accordingly, page numbers are successively entered, starting from the highest one. At this time, page numbers may also be entered in the form of "n/n", "n−1/n", "n−2/n" and so forth.

[Sixth Embodiment]

Figure 6:
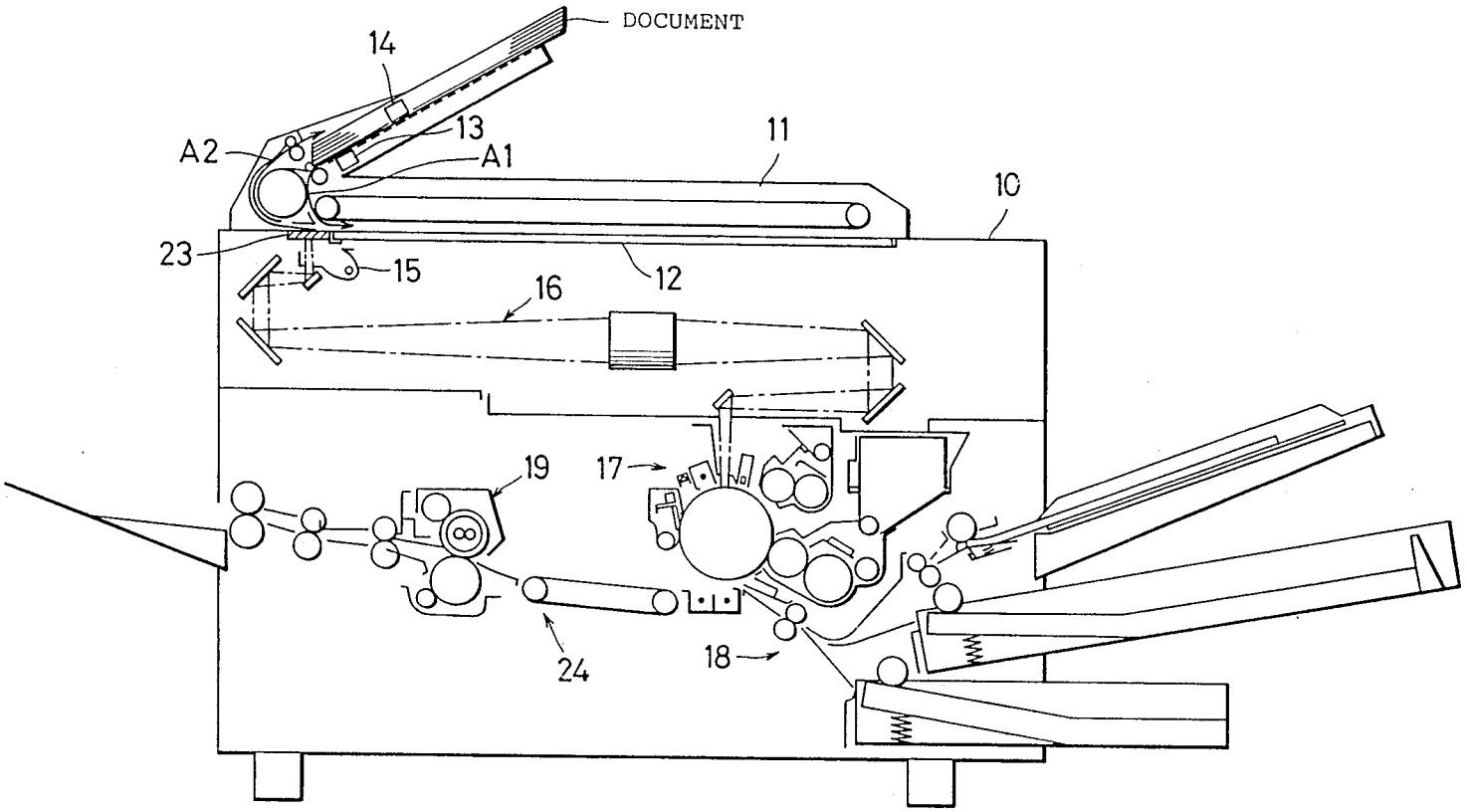
FIG. 6 is a schematic section view illustrating the arrangement of an electrophotographic copying machine having an RDH, to which applied is the page entering apparatus in accordance with another embodiment of the present invention.

The present invention may be applied to an electrophotographic copying machine having a RDH 11 and provided at the main body 10 with no intermediate tray, as shown in FIG. 6.

In FIG. 6, a copy paper delivery mechanism 24 of the main body 10 is not provided with the switching guides 20, 21 and the intermediate tray 22 as shown in FIG. 1. Accordingly, the copy paper on which a copying operation has been once made, is discharged as it is.

Figure 7:
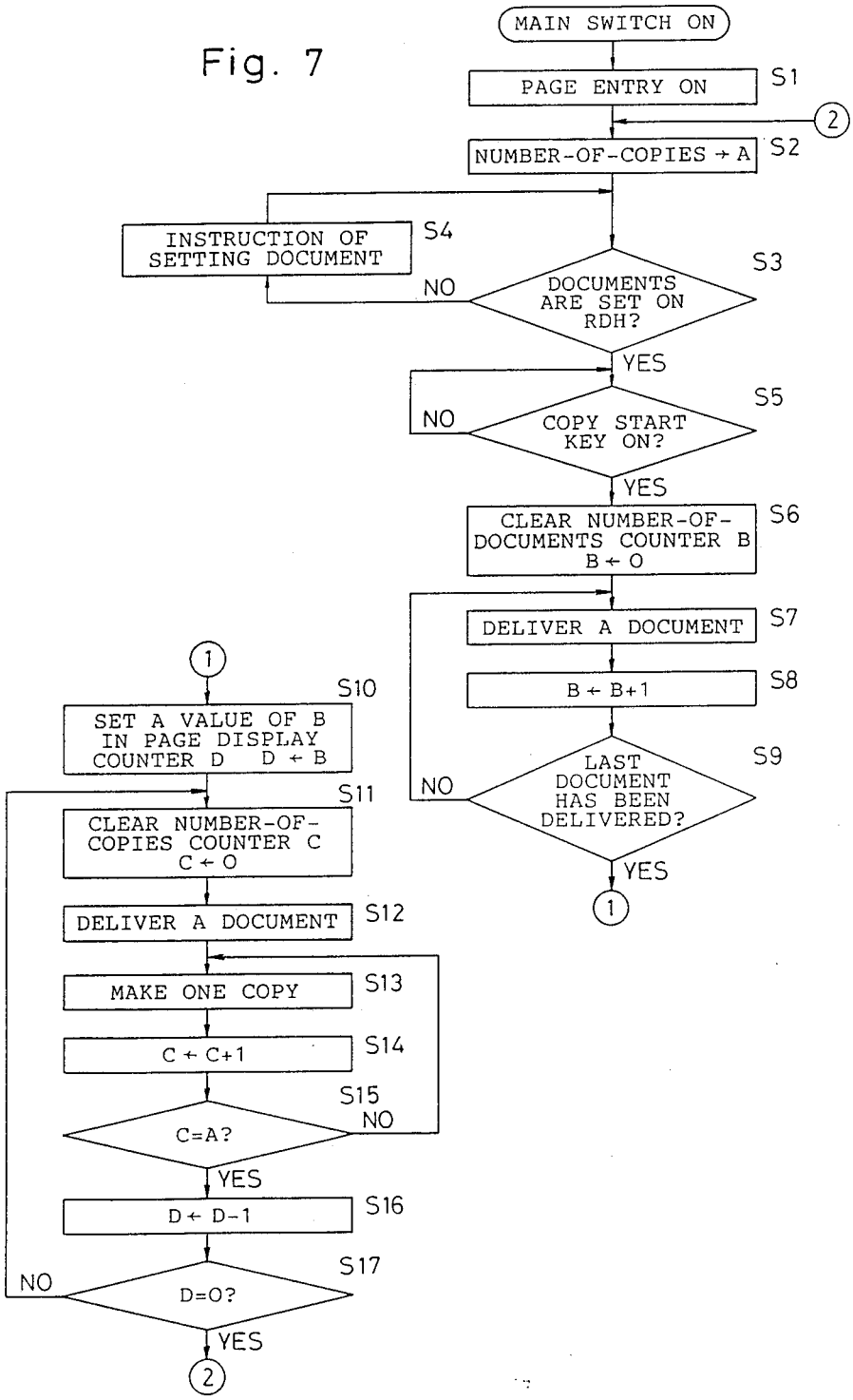
FIG. 7 is a flow chart illustrating page entry control operations in the electrophotographic copying machine in FIG. 6.

FIG. 7 shows a flow chart illustrating the operations of the control circuit in FIG. 2. The following description will discuss the operations of the electrophotographic copying machine to which the sixth embodiment is applied, along the flow in FIG. 7 and with reference to FIGS. 6 and 2.

When the page entry ON/OFF key 32 is turned ON with the main switch of the main body turned ON, the control circuit is set to a page entry ON mode (step S1). In this mode, when the number of copies is entered by the number-of-copies setting key 33, the CPU 29 sets such number data in the number-of-copies memory area A of the RAM 31 (step S2). Then, it is judged based on an input signal from the document set detecting sensor 13 whether or not documents are set on the RDH 11 (step S3). If no documents are set on the RDH 11, a document setting instruction is given (step S4). Such instruction may be displayed on, for example, a display unit (not shown) disposed at the main body 10 or a display unit disposed at the RDH 11. Such instruction may also be supplied with sound.

When the CPU 29 judges that the copy start key 34 has been turned ON (step S5), the CPU 29 sends a signal to the CPU 37 and the CPU 37 controls to execute operations of steps S6 to S9. That is, the CPU 37 clears the number-of-documents counter B included in the RAM 39 (step S6) and controls the document delivery means 42 so that one document of the documents set on the RDH 11 is circulated by the document delivery means 42 (step S7). Then, the number-of-documents counter B is incremented by +1 (step S8). These operations are repeated until the last document is circulated (step S9–S7–S8–S9).

When the last document detecting sensor 14 judges that the last document has been circulated (step S9), the CPU 37 informs, to the CPU 29, a count value of the number-of-documents counter B, for example n. The CPU 29 sets this count value n to the page display counter D (step S10). As will be discussed later, the value n set on this page display counter D is displayed on the page number display 23.

Then, the CPU 29 clears the number-of-copies counter C of the RAM 31 (step S11) and causes the RDH 11 to deliver the first document to the transparent platen 12 (step S12). The CPU 29 controls to execute a one-copy operation (step S13) and increments the number-of-copies counter C by +1 (step S14). The copying operation is continued until the count value of the number-of-copies counter C reaches the number of copies A previously set in the memory area A at the step S2 (steps S15–S13–S14–S15). As discussed in connection with the step S10, the page number display 23 displays the count value n of the page display counter D. At the first copy, the total number of the documents n is displayed on the page number display 23. This is because, in the RDH 11, a plurality of initially set documents are successively set on the transparent platen 12, starting from the last-page document, as mentioned earlier. Accordingly, the last page number of the documents n is entered on the copy paper. When the count value of the number-of-copies counter C is identical with the preset number of copies A at the step S15, the CPU 29 causes the count value of the page display counter D to be subtracted by 1 so that the count value is equal to "n−1" (step S16). Accordingly, the display value on the page number display 23 is subtracted by 1 so that the display contents are equal to "n−1".

It is judged whether or not the count value of the page display counter D is equal to zero (step S17). If the count value is not equal to zero, the control operations on and after the step S11 are repeated. When it is judged at the step S17 that the count value of the page display counter D is equal to zero, a series of copy control operations are finished and the sequence is returned to the step S2.

As thus described, each of the documents is circulated twice in the RDH 11. On the first circulation, only the number of documents is counted. On the second circulation, the documents are copied and, based on the number of documents thus obtained, the page numbers are entered in the copy paper sheets, starting from the last page number. Thus, even though the intermediate tray is not disposed, the number of documents may be automatically counted and page entry may be made.

According to this embodiment, when page entry is made at the step S13, the number of documents B is already known. Accordingly, the page numbers may be entered in such manner as to represent the relationship with respect to the total number of the documents, i.e., the page numbers may be entered in the form of "n/n", "n−1/n", "n−2/n" and so forth.

In this embodiment, the RDH may be of the type in which the documents are successively fed, starting from the first one. In this case, the total number of documents n is known by the circulation of documents in the RDH. Accordingly, page entry may be made in the form of "1/n", "2/n", "3/n" and so forth.

[Seventh Embodiment]

Figure 8:
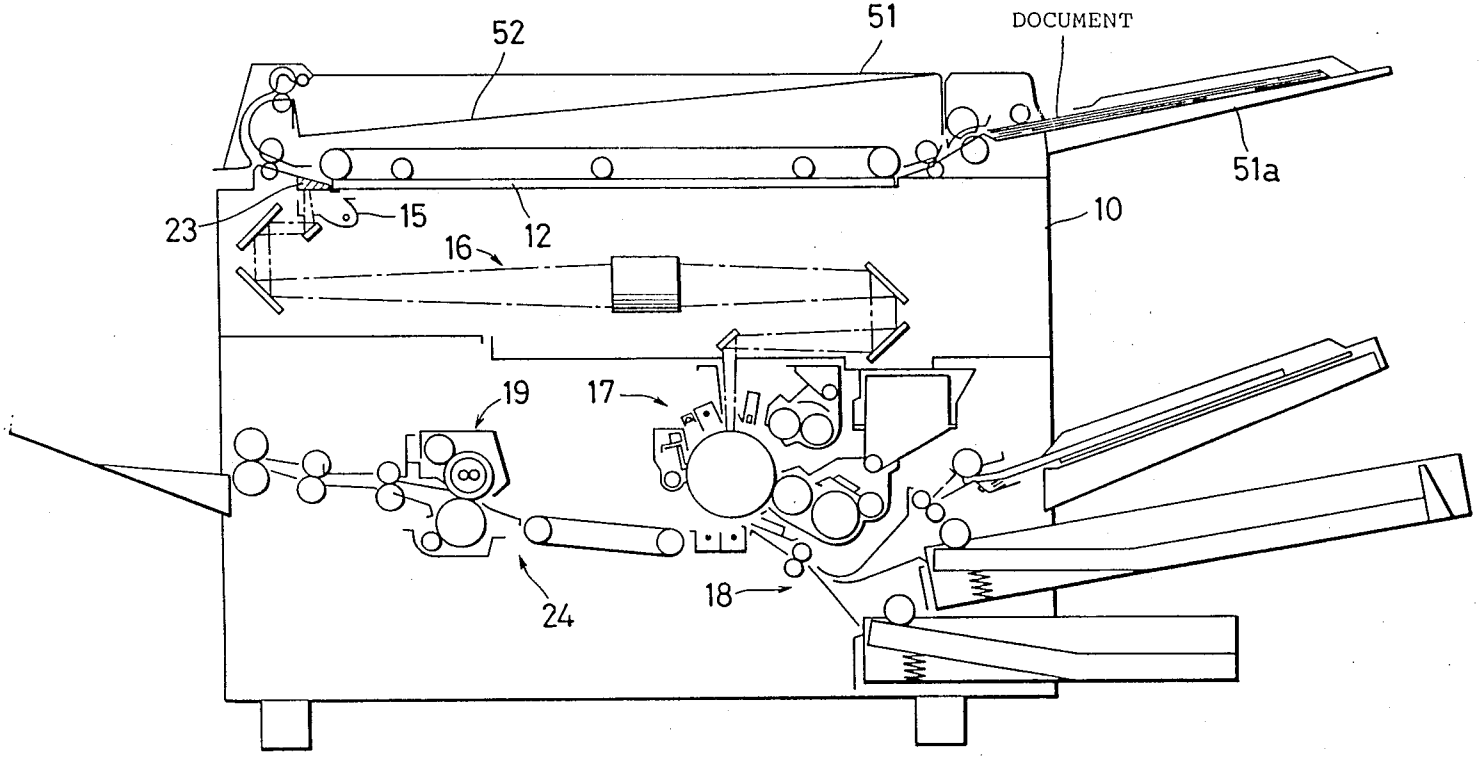
FIG. 8 is a schematic section view illustrating the arrangement of an electrophotographic copying machine having a non-circulation type ADF, to which applied is the page entering apparatus in accordance with a still further embodiment of the present invention.

In the sixth embodiment, the description has been made on the electrophotographic copying machine provided on the main body 10 with the RDH 11. However, the present invention may be applied to not only the electrophotographic copying machine provided on the main body 10 with the RDH 11, but also an electrophotographic copying machine provided on the main body 10 with an ADF 51 instead of the RDH 11, as shown in FIG. 8.

In such application, a document once sent is received by a document receiving portion 52 in the ADF 51, and is not circulated as done in the RDH 11. Accordingly, when the number of documents is counted by the ADF 51, it is required to manually set again the documents received by the document receiving portion 52.

[Other Embodiments]

According to the first to the seventh embodiments, provision is made such that page entry is made by a copying operation made simultaneously with a copying operation of documents, or page entry is made in copy paper on which documents have been once copied. However, the present invention may be arranged such that page numbers are printed, from a thermal head with the use of an ink donor sheet, on the copy paper for which copying and fixing operations have been finished, before the copy paper is discharged (JP laid open patent publication Nos. 53665/1986 and 77459/1984). Also, the present invention may be arranged such that the page numbers are printed with a stamp (JP laid open patent publication Nos. 15150/1980 and 24486/1983).

When the intermediate tray 22 is disposed, a page entering apparatus of the thermal head type or the stamp type may be disposed in the copy paper delivery passage from the intermediate tray 22 to the image forming mechanism 17 in FIG. 1, or in the copy paper delivery passage from the fixing device 19 to the intermediate tray 22. When the intermediate tray 22 is not utilized, the page entering apparatus may be generally disposed downstream of the fixing device 19 in FIG. 6. However, the page entering apapratus may also be disposed at the copy paper feeding mechanism 18.

While the present invention has thus been described with reference to the attached drawings, it will be understood that the invention should not be limited to the particular embodiments above-mentioned, but the same may be varied in many ways without departing from the scope of the invention.

We claim:

1. A page entering apparatus applied to an electrophotographic copying machine having an automatic document feeder for automatically feeding documents to be copied, one by one, and an intermediate housing portion for temporarily housing copy paper on which the documents have been copied, comprising:

counting means for counting, at the time of copying operation, the total number of documents fed from the automatic document feeder;

page number storing means for storing a page number based on a count value of said counting means; and page number entry processing means for executing a page number entry processing based on an output from said page number storing means, after the copy paper has been housed in the intermediate housing portion.

2. A page entering apparatus applied to an electrophotographic copying machine having an automatic document feeder for automatically feeding documents to be copied, one by one, and an intermediate housing portion for temporarily housing copy paper on which the documents have been copied, comprising:

storing means for storing the preset number of copies;

counting means for counting the number of copy paper sheets housed in the intermediate housing portion;

operating means for calculating the number of documents based on said preset number of copies stored in said storing means and a count value of said counting means; and page number entry processing means for executing a page number entry processing based on the number of documents calculated by said operating means, after the copy paper has been housed in the intermediate housing portion.

3. A page entering apparatus for an electrophotographic copying machine according to claim 2, wherein the documents are copied before the copy paper is housed in the intermediate housing portion.

4. A page entering apparatus for an electrophotographic copying machine according to claim 2, wherein the documents are copied after the copy paper housed in the intermediate housing portion has been taken out.

5. A page entering apparatus for an electrophotographic copying machine according to claim 1 or 2, wherein the automatic document feeder is of the recirculation-type that the documents are circulated.

6. A page entering apparatus for an electrophotographic copying machine according to claim 1 or 2, wherein the automatic document feeder is of the non-recirculation type that the documents are not circulated.

7. A page entering apparatus for an electrophotographic copying machine according to claim 1 or 2, wherein the automatic document feeder is of the type that a plurality of set documents are successively fed, starting from the last-page document.

8. A page entering apparatus for an electrophotographic copying machine according to claim 1 or 2, wherein the automatic document feeder is of the type that a plurality of set documents are successively fed, starting from the first-page document.

9. A page entering apparatus applied to an electrophotographic copying machine having an automatic document feeder for automatically feeding set documents one by one, comprising:

counting means for counting the total number of the set documents with the use of the automatic document feeder, before executing a copying operation;

page number storing means for storing a page number based on a count value of said counting means; and page number entering means for entering a page number supplied from said page number storing means, in copy paper, in association with the copying operation.

10. A page entering apparatus for an electrophotographic copying machine according to claim 9, wherein the automatic document feeder is of the recirculation-type that the documents are circulated.

11. A page entering apparatus for an electrophotographic copying machine according to claim 9, wherein the automatic document feeder is of the non-recirculation type that the documents are not circulated.

12. A page entering apparatus for an electrophotographic copying machine according to claim 9, wherein the automatic document feeder is of the type that a plurality of set documents are successively fed, starting from the last-page document.

13. A page entering apparatus for an electrophotographic copying machine according to claim 9, wherein the automatic document feeder is of the type that a plurality of set documents are successively fed, starting from the first-page document.

14. A page entering apparatus for an electrophotographic copying machine according to claim 1, wherein page numbers are entered in copy paper with the copying operation utilized.

15. A page entering apparatus for an electrophotographic copying machine according to claim 1, wherein page numbers are entered in copy paper with the use of other means than electrophotographic means.

16. A page entering apparatus for an electrophotographic copying machine according to claim 1, wherein page numbers are entered in the form of a fraction.

* * * * *